US005490715A

United States Patent [19]

Opsvik

[11] Patent Number: 5,490,715

[45] Date of Patent: Feb. 13, 1996

[54] ARRANGEMENT IN A CHAIR

[76] Inventor: Peter Opsvik, Pilestredet 27 H, N-0164 Oslo, Norway

[21] Appl. No.: 81,335

[22] PCT Filed: Jan. 20, 1992

[86] PCT No.: PCT/NO92/00012

§ 371 Date: Jun. 21, 1993

§ 102(e) Date: Jun. 21, 1993

[87] PCT Pub. No.: WO92/12653

PCT Pub. Date: Aug. 6, 1992

[30] Foreign Application Priority Data

Jan. 21, 1991 [NO] Norway ..... 910232

[51] Int. Cl.[6] ..... A47C 3/02

[52] U.S. Cl. ..... 297/310; 297/258.1; 297/302.4; 297/270.1

[58] Field of Search ..... 297/258, 265, 297/267, 270, 302, 310, 325; 248/188.9, 618; 472/95, 135, 137; 482/52, 123, 130

[56] References Cited

U.S. PATENT DOCUMENTS

| | | | |
|---|---|---|---|
| 77,161 | 4/1868 | Blake | 248/188.9 |
| 414,675 | 11/1889 | Caldwell | 297/302 X |
| 490,366 | 1/1893 | Seng | 297/310 X |
| 1,490,132 | 4/1924 | Sheehy | 248/188.9 |
| 1,526,920 | 2/1925 | Liptak | 297/325 X |
| 1,861,661 | 6/1932 | Huerlin | 472/135 X |
| 2,101,422 | 12/1937 | Assalit | 297/302 |
| 2,244,614 | 6/1941 | Fox . | |
| 3,078,479 | 2/1963 | Grosse et al. | 472/135 X |
| 3,427,019 | 2/1969 | Brown . | |
| 3,475,019 | 10/1969 | Mutter et al. | 472/135 |
| 3,494,613 | 2/1970 | Hatfield | 472/135 |
| 3,848,883 | 11/1974 | Breacain | 297/310 X |
| 3,870,364 | 3/1975 | Cortina O. | 297/310 X |
| 3,938,857 | 2/1976 | Craig . | |
| 4,131,260 | 12/1978 | Ambasz . | |
| 4,372,606 | 2/1983 | Faull . | |

FOREIGN PATENT DOCUMENTS

| | | |
|---|---|---|
| 914419 | 9/1945 | France . |
| 156634 | 7/1987 | Norway . |
| 2241433 | 9/1991 | United Kingdom . |

*Primary Examiner*—Peter R. Brown
*Attorney, Agent, or Firm*—Darby & Darby

[57] ABSTRACT

The present invention relates to an arrangement in a chair, which for the object of giving the chair (1) a floating or heaving property is specific in that the chair (1) comprises one or more resilient elements (*5a–5d*) rendering the chair (1) freedom of movement in both vertical and side-wise directions as well as in forward and rearward directions.

6 Claims, 9 Drawing Sheets

-18

ARRANGEMENT IN A CHAIR

FIELD OF THE INVENTION

The present invention relates to an arrangement in a chair.

The present arrangement is adaptable to all types of chairs, but will have a specific application within the category of chairs comprising so-called conference chairs, dining-room chairs and working chairs.

PRIOR ART

U.S. Pat. No. 2,244,614 (Fox) relates to a rocking chair in which there is allowed an even rocking movement, especially by means of further springs. Said springs are located between curved strips attached to the seat frame and supporting rails, but do not allow for the possibility for moving the chair itself in the vertical direction, let alone in any sideways directions. Further, the rocking chair according to U.S. Pat. No. 2,244,614 is based on the principle of having an arched runner as basis for the rocking movement.

U.S. Pat. No. 3,368,843 (Caldemeyer) also relates to a rocking chair in which the rocking movement itself is based on arched side rails. Apart from suggesting a specific type of arched runners, this patent publication does not suggest a chair allowing a combined vertical movement and rocking movement.

U.S. Pat. No. 4,372,606 (Faull) suggests a specific type of rocking chair, in which a plurality of springs are located between two plates, there being between said plates provided a plurality of pipes keeping the two plates at a specific distance at the central area thereof. Since at least two such pipes must be provided, there will only be allowed movement in the "rocking" direction, which means that the prior art structure exclude a combined movement in the vertical plane as well as sideways tilting of the chair.

FR 914 419 (Nyström) also relates to a specific type of rocking chair, but neither does this prior art chair allow any movement in the vertical plane or any sideways movement of the chair.

NO 156.634 (Kjersem) discloses so-called tilting runners for being mounted in pairs on the base of a chair, such runners allowing a tilting of the chair for thereby altering the angle of the seat member in relation to a horizontal plane. However, according to this publication there is no suggestions as to means allowing for a floating or heaving movement of the chair in question.

SUMMARY OF THE INVENTION

An object of the present invention is to provide an arrangement in a chair, which allows the chair to "yield" in all directions, which thereby should provide a floating or heaving or even air-walking movement when the user takes her or his various chair sitting positions.

A further object of the present invention is in such a chair with expanded liberty of movement, to limit the soft movements of the chair for thereby rendering stabile maximum forwardly tilting and rearwardly tilting positions, respectively.

A still further object of the present invention is to provide an arrangement in a chair that may be mass-produced at a low cost in respect to both material and labour.

Yet another object of the present invention is to provide an arrangement in a chair which in a non-expensive and efficient manner can be included in not only novel chair designs, but also in existing chair designs.

These objects are achieved in an arrangement as stated in the preamble, which according to the present invention is characterized in that the chair comprises one or more resilient elements redering the chair freedom of movement in both vertical and side-wise directions, as well as in forward and rearward directions.

Said one ore more resilient element(s) may appropriately constitute the only connection between the chair seat member and a chair supporting member or floor supporting member.

Further, such resilient elements may for example be implemented as for example helical springs, rubber elements, plastic elements, laminates, air pillows, etc, or a combination thereof.

Still further, said resilient elements may be located as far down on the chair as possible.

Alternatively, said resilient elements may be located just below the chair seat member.

Accordingly, the objects are achieved in an arrangement in a chair, which comprises one or more resilient elements which are located at one ore more lower portions of the chair for thereby resting directly on the floor or through a stationary lower part of the chair, or which element or elements are located immediately below the chair seat member, such elements rendering the chair the versatility of allowing movement both vertically and sideways, as well as forwardly and rearwardly.

Further features and advantages of the present arrangement appears from the following detailed description, taken in conjunction with the appended drawings, as well as from the appended patent claims.

BRIEF DISCLOSURE OF THE DRAWINGS

DETAILED DISCLOSURE OF THE EMBODIMENTS

Figure 1:
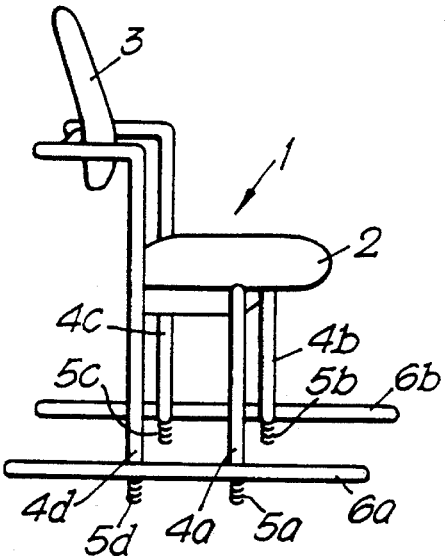
FIG. 1 is a perspective view of an embodiment of an arrangement in a chair according to the present invention, here comprising one helical spring beneath each chair leg and in combination with supporting rods.

In FIG. 1 which is a perspective view of a first embodiment of an arrangement according to the present invention, reference numeral 1 designates the chair itself, which here comprises a seat member 2, a back member 3, as well as four legs, 4*a*, 4*b*, 4*c* and 4*d*, respectively.

Underneath each of the legs 4*a*–4*d* there are positioned a resilient element, 5*a*, 5*b*, 5*c* and 5*d*, respectively, and such resilient elements 5*a*–5*d* render the chair a freedom of movement not only in the forward direction and the rearward direction, but also in the vertical direction as well as in any side-wise direction.

In the embodiment illustrated in FIG. 1, in which the resilient elements are mounted on the lowermost portions of each leg, each resilient element 5*a*–5*d* rests directly on the floor, respectively, and each of the resilient elements can, of course, yield in all directions, which means in vertical direction and to any side of the chair.

When using the chair, the user will thus achieve a floating or heaving movement, and will consequently have the feeling of "gliding" upon the chair.

It is to be understood that such resilient elements may be constituted by for example helical springs, rubber elements, plastic elements, laminated elements, air pillows, etc, used separately, or in combination, all of which under the prerequisite that the yielding of the elements and the location thereof bring forth a resilient and soft movement of the chair whilst being used, said elements either implicitly or together with other appropriately means allowing for movements which are kept within normal "user positions" of the chair.

Figure 3:
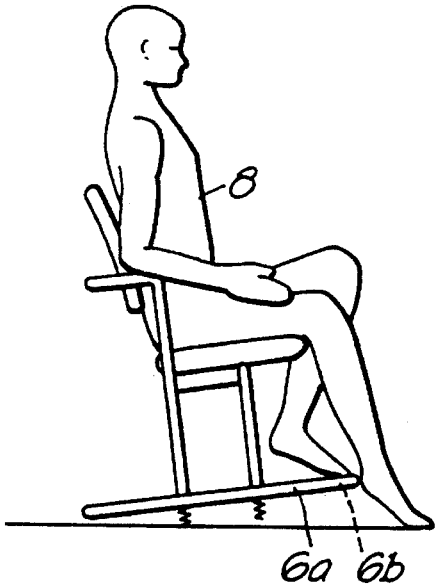
FIG. 3 is a side view similar to FIG. 2, and illustrates a rearwardly tilting sitting position in which the user can utilize any of the supporting rods as foot rests.
Figure 4:
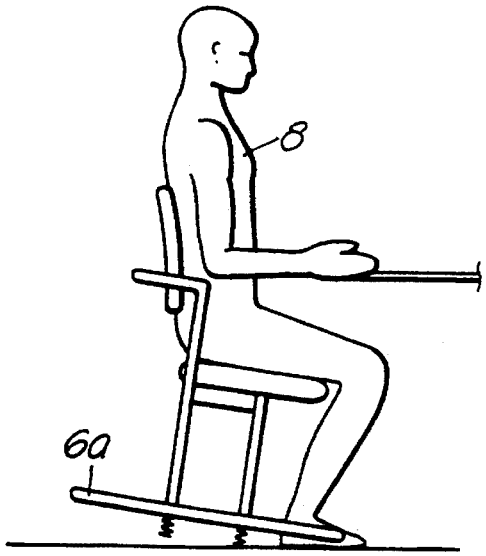
FIG. 4 is a side view similar to FIG. 2, wherein the user takes a forwardly tilting sitting position.

In the embodiments according to FIG. 1, there are on each side of each pair of legs provided side rods, 6*a* and 6*b*, respectively, which serve as stopper means, especially in a maximum forwardly tilting position, as this is illustrated in FIG. 4, and in an maximum rearwardly tilting position, as this is illustrated in FIG. 3, said side-wisely extending supporting rods 6*a* and 6*b* serving as foot rests for the user of the chair, see especially FIG. 3.

Figure 2:
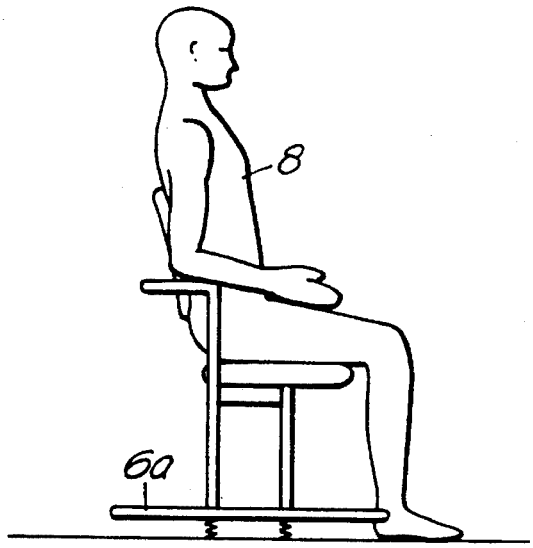
FIG. 2 illustrates in side view the chair according to FIG. 1, including a user sitting a central position.

In FIG. 2 there is illustrated a side view of the chair 1 according to FIG. 1 including a user 8 sitting a central position, whereas FIGS. 3 and 4 illustrated an extreme rearwardly tilting and an extreme forwardly tilting position, respectively. It is to be understood that the chair 1 according to FIGS. 1–4 can be used both as an office chair and especially as a conference chair, said chair giving the user 8 a possibility to take various floating or heaving positions, which means a comfortable and appropriate variation of the position of the body, which is favourable in connection with longer sitting periods.

Figure 5:
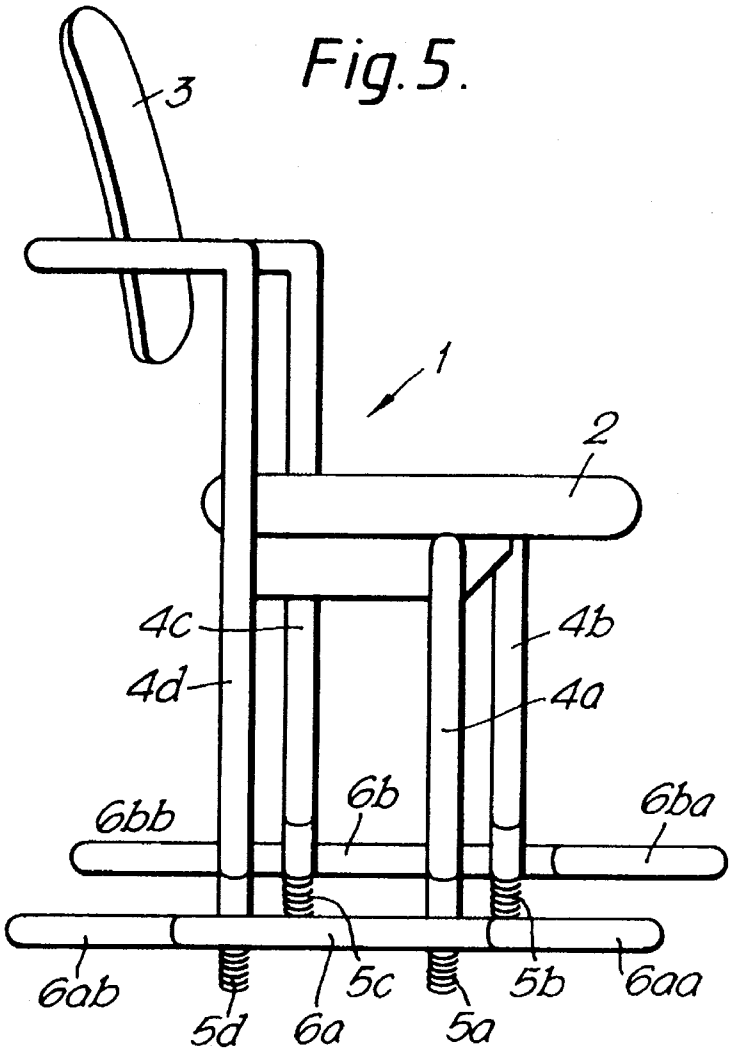
FIG. 5 illustrates in a larger scale an embodiment which is very similar to the embodiment of FIG. 1.

In FIG. 5 which on a larger scale illustrates an embodiment which is very similar to the embodiment according to FIG. 1, there is indicated on each side-wise extending supporting bar 6*a* and 6*b*, respectively, front portions 6*aa* and 6*ba*, respectively, as well as rear portions 6*ab* and 6*bb*, respectively, which could be detachably mounted on the respective supporting rod, which means that the chair 1 could optionally be without stopper means 6*aa* and 6*ba*, or without rear stopper means 6*ab* and 6*bb*. The possibility of removing parts of the supporting rods 6*a* and 6*b*, would be in dependence of the stiffness of the resilient elements 5*a*–5*d*, as well as space requirements in the environments where such chairs are to be utilized.

Figure 6:
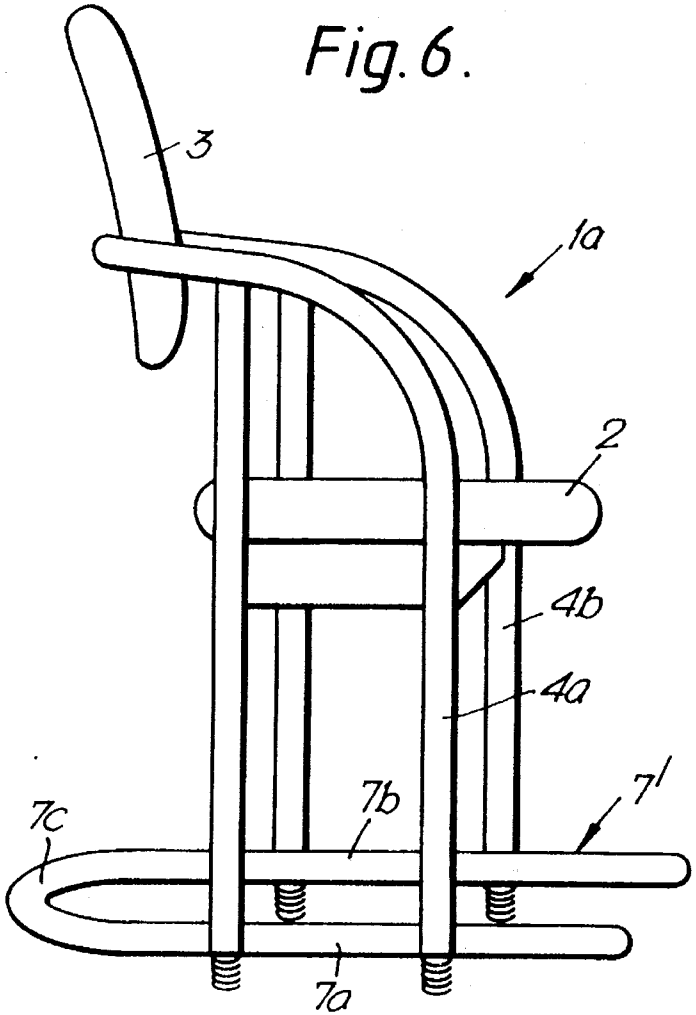
FIG. 6 is on a larger scale a perspective view of a variant of the chair according to FIG. 5.

In FIG. 6 which illustrates a variant of the chair according to FIG. 5, this chair la is provided with a lower supporting bar 7' having U-shaped form, which means that the side-wise extending bar portions 7*a* and 7*b* are tied together at the rear of the chair by means of a curved rod portion 7*c*. Otherwise, the chair 1*a* in FIG. 6 is similar to the chair 1 in FIG. 5, but the front legs 4*a* and 4*b* are here extended upwardly and are curved rearwardly to join the arm rests holding the back member 3.

Figure 7:
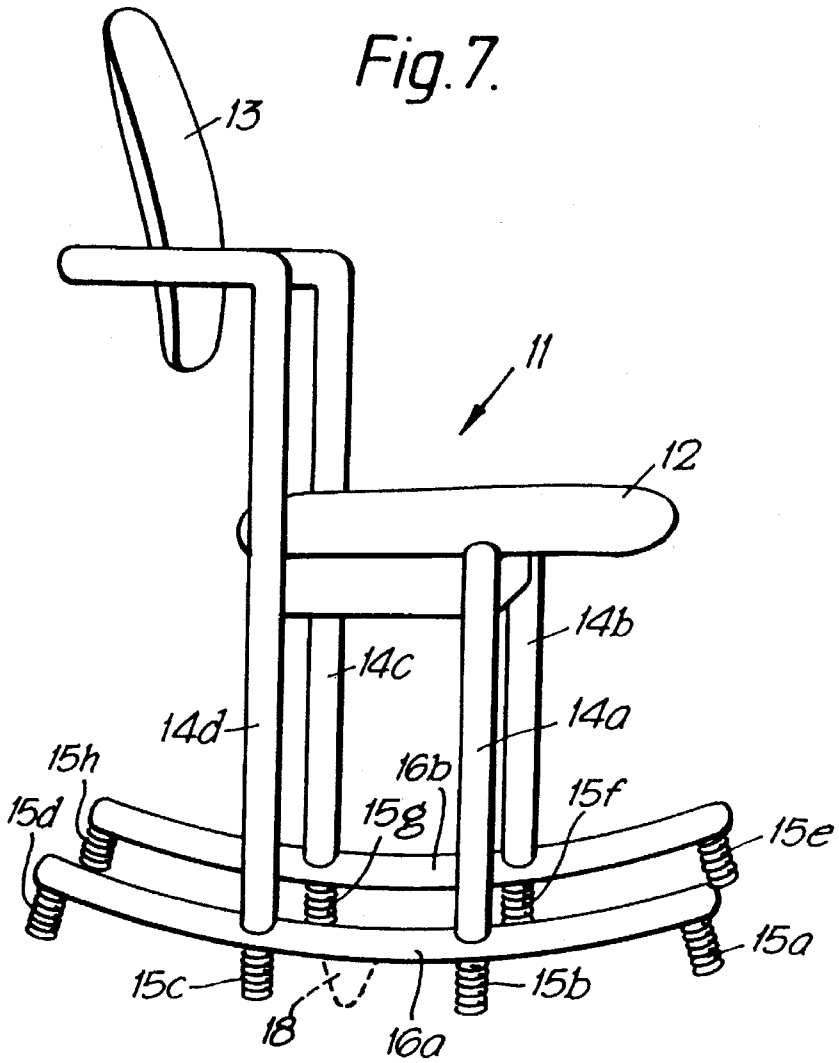
FIG. 7 illustrates a side view of another embodiment of an arrangement in a chair according to the invention, comprising side runners with resilient elements.

In FIG. 7 which in perspective view illustrate another embodiment of the arrangement according to the present invention, the chair 11 also here provided with seat member 12 and a back member 13, as well as four legs 14*a*, 14*b*, 14*c* and 14*d* which at their lower portions merge into slightly or partly curved runners 16*a* and 16*b* respectively. Below each of the runners 16*a* and 16*b* there are provided a plurality of resilient elements, 15*a*, 15*b*, 15*c*, 15*d* and 15*e*, 15*f*, 15*g*, 15*h*, respectively. When the chair 11 is in the position illustrated in FIG. 7, i.e., in a central unused position, only the central pair of resilient elements on each runner will touch the floor directly, i.e., elements 15*b* and 15*c* on runner 16*a* and resilient elements 15*f* and 15*g* on runner 16*b*.

During use the intermediate resilient elements 15*b*, 15*c*, 15*f* and 15*g* will render the chair a liberty of movement both in vertical direction as well as in any sideways tilting direction, including forwardly and rearwardly tilting. When the chair is tilted forwardly, this forward movement will be gently stopped by the front resilient elements 15*a* and 15*e*, whilst the chair in its rearward position will be gently stopped by the rear resilient elements 5*d* and 5*h*. At the same time the user may tilt side-wise within certain limits, and the front portions of the supporting rods 16*a* and 16*b* may also here be used as foot rests, or stopper means, respectively.

The resilient elements 15*a*–15*h* may here be constituted by helical springs, rubber cushions or plastic cushions and in addition there may in the central portion of the supporting rods be located a further resilient element, which is here indicated with dotted lines and designated with reference numeral 18, such further element having such yielding properties that the previously discussed gliding or floating movements of the chair may be retained.

Figure 8:
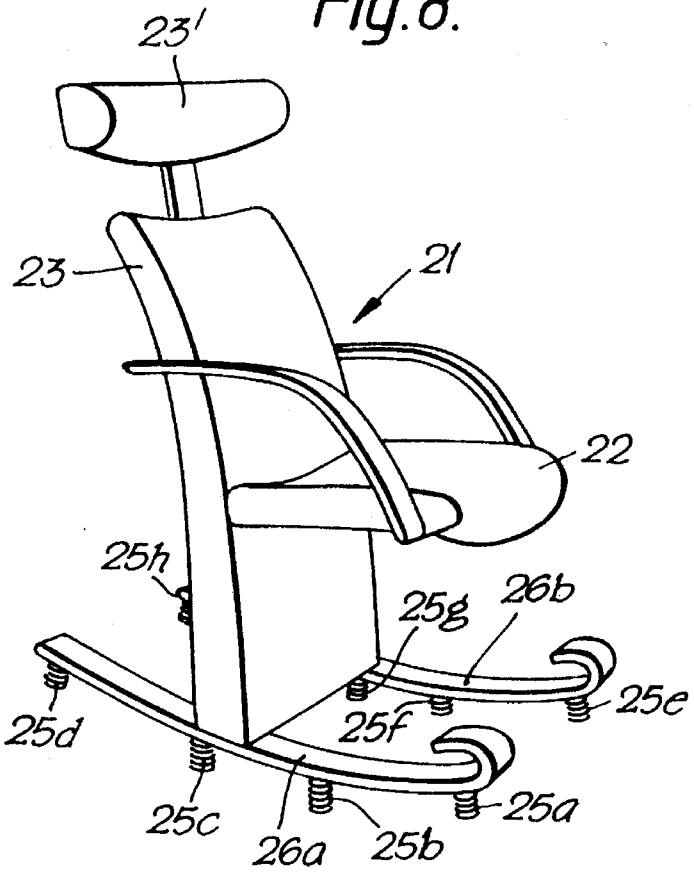
FIG. 8 illustrates a perspective view of a variant of the embodiment according to FIG. 7.

In FIG. 8 there is illustrated in a perspective view some sort of a variant of the embodiment according to FIG. 7, the chair 21 also here being provided with a seat member 22 as well as a back member 23 and a head rest 23'. The back member 23 is here prolonged as a flat member below the area of the seat member 22, for as an integral member without specific legs being supported by two specific runners 26*a* and 26*b*, each of which are provided with four resilient elements, 25*a*, 25*b*, 25*c*, 25*d* and 25*e*, 25*f*, 25*g*, 25*h*, respectively. It is to be understood that the resilient elements 25*a*–25*h* can have different resilient properties depending on their mounting position, and a combination of resilient properties and locations will give this embodiment of a chair the possibility of further variants as regards the floating or heaving movements thereof.

The specific shape of each of the runners 26*a* and 26*b*, resides in a neatly curved front portion of each of said runners.

Both in FIG. 7 and FIG. 8 there has been illustrated embodiments of runners which have a generally curved shape, i.e., similarly to previously known curved rocker chair runners, but it is to be understood that variants of such embodiments could include straight runners, as discussed in for example connection with FIG. 5 and FIG. 6.

Figure 9:
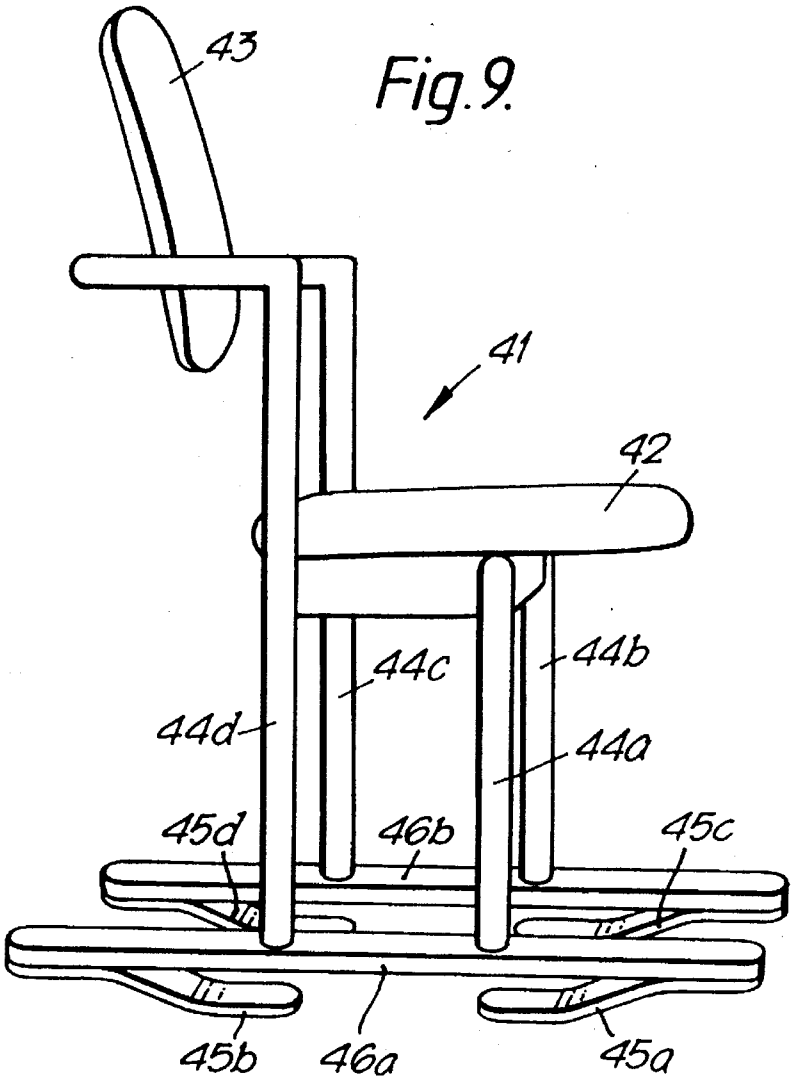
FIG. 9 is a perspective view of an embodiment comprising resilient laminated elements.

In FIG. 9 there is illustrated a perspective view of an embodiment of a chair according to the present invention, in which the chair 41 comprising four legs 44*a*–44*d*, rests on two supporting rods 46*a* and 46*b*, each of which rods 46*a* and 46*b*, respectively, resting on resilient laminated elements 45*a*, 45*b* and 45*c*, 45*d*, respectively. Also such laminated elements 45*a*–45*d* will render the user of a chair a floating or heaving movement allowing tilting in any direction of the chair, including vertical displacements. In addition, the supporting rods 46*a*, 46*b* may serve as stopper means for forward and rearward extreme tilting positions, as well as foot rests for the user of the chair.

Figure 10:
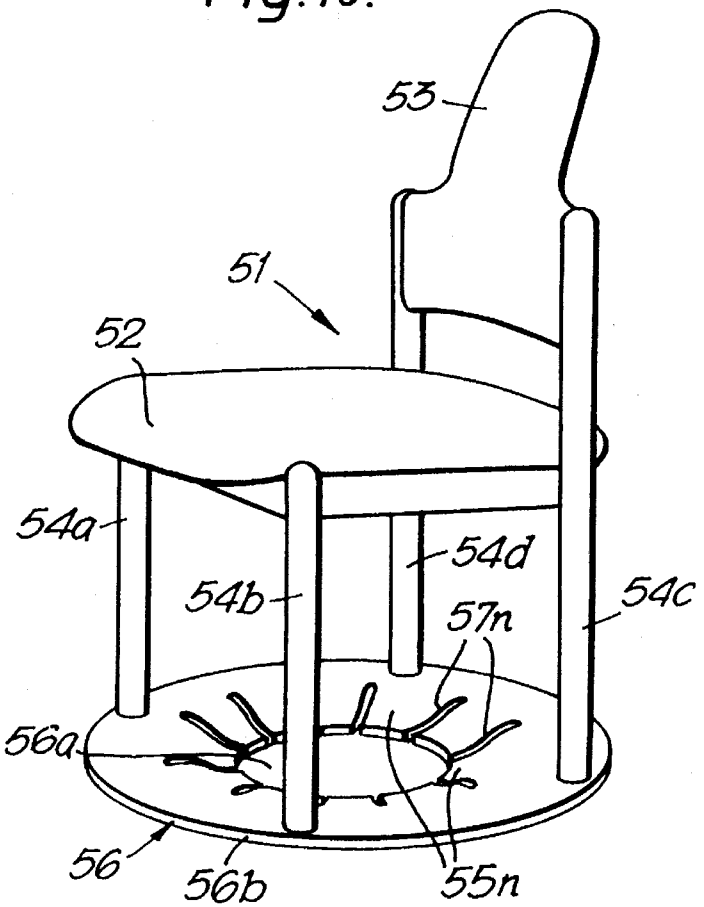
FIG. 10 is a perspective view of a variant of an embodiment comprising resilient laminated elements.

In FIG. 10 which prespectively illustrates a special embodiment of a chair 51 in which the arrangement according to the invention has been implemented. The chair 51 is provided with a seat member 52 and a back rest 53, as well as four legs 54*a*–54*d* which rest on a circular supporting element 56, shaped like a round disc, but having a central opening 56*a* and being provided with a plurality of curved tongues or curved laminates 55*n* extending from the inner edge of the opening 56*a* towards the circumferential edge 56b of the disc-shaped supporting element 56, with appropriate slits 57*n* being arranged therebetween. The ring- or disc-shaped supporting element 56 will due to the resilient properties of the tongues 55*n* give the user of the chair full freedom in tilting the chair in any direction around a vertical central axis, as well as allowing a vertical upwardly and downwardly resilient movement in addition thereto.

It is to be understood that the use of laminated or tongue-shaped resilient elements, as illustrated in FIGS. 9 and 10, can be varied within wide limits, said laminated elements for example taking the shape of a trapezoid, in which example this arrangement could be included in chairs having less than four legs.

Figure 11:
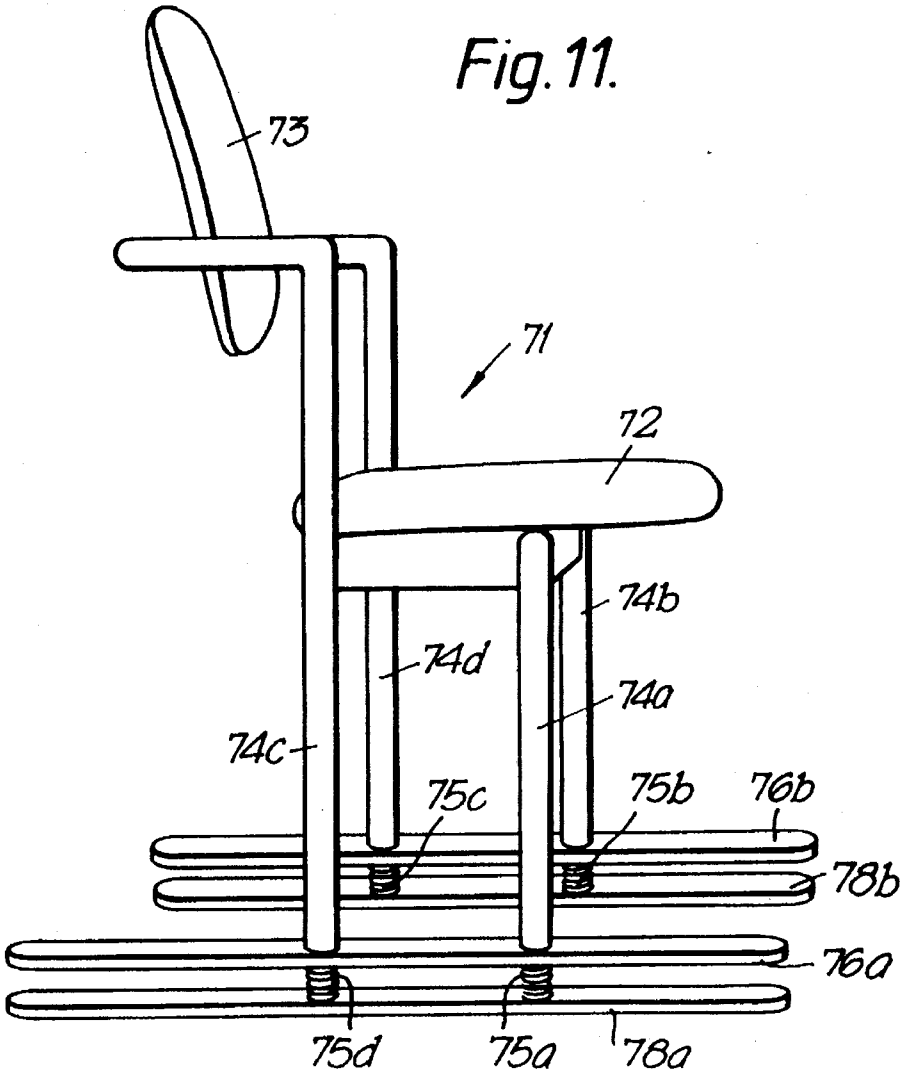
FIG. 11 is a perspective view of a variant of the chair illustrated in FIG. 1, here implemented with intermediate resilient elements.

In FIG. 11 there is illustrated in perspective view a variant of the chair illustrated in FIG. 1, the chair 71 here being provided with resilient elements 75*a*–75*d* which are arranged between two along the side of the chair extending rods 78*a* and 78*b*, which are stationary in relation to the floor, and to runner-like rods 76*a* and 76*b*. It is to be understood that the lowermost supporting rods 78*a* and 78*b* could be replaced by a plate or similar, which also is stationary and resting on the floor.

Figure 12:
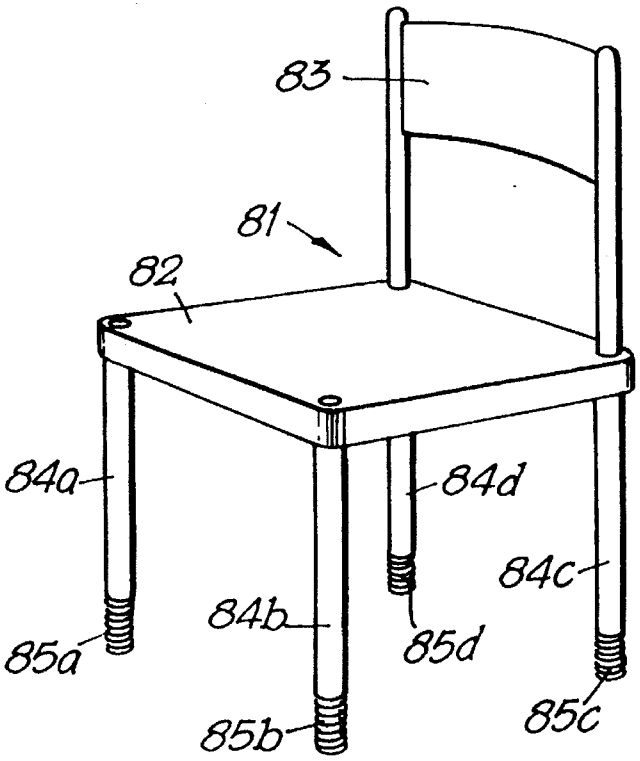
FIG. 12 illustrates perspectively a still further embodiment of an arrangement included in a four-legged chair.

FIG. 12 illustrates in a perspective view a chair 81 having a seat member 82 and a back member 83 as well as four legs 84*a*–84*d*, each leg being provided with a lowermost resiliant element 85*a*, 85*b*, 85*c*, 85*d*, respectively, each of said elements resting directly on the floor.

Figure 13:
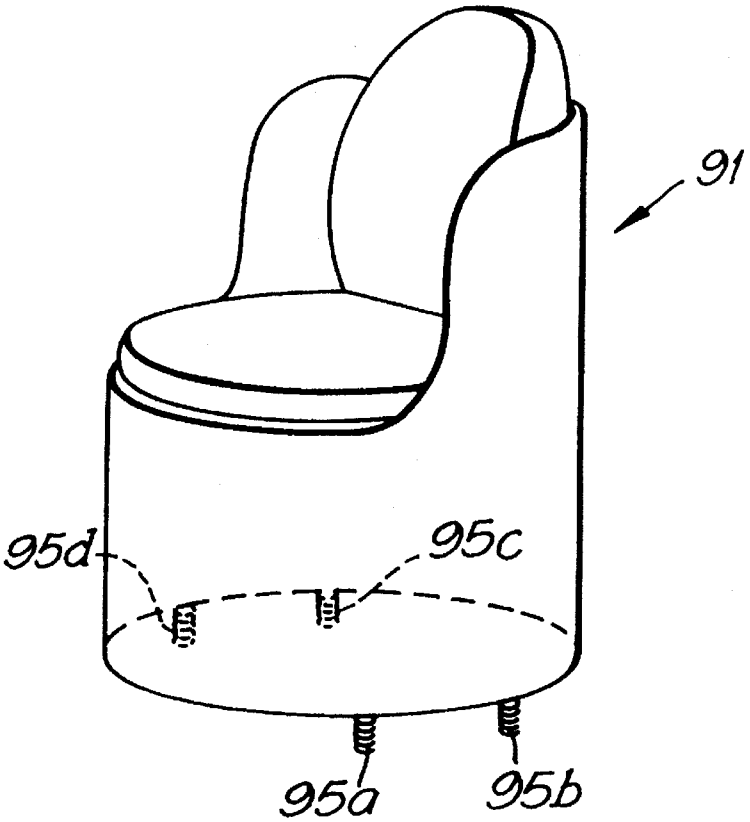

FIG. 13 illustrates in a perspective view a so-called "log chair" 91, which with its lowermost portion rests on a plurality of resilient elements 95*a*–95*d* rendering the chair the above discussed properties, and which are located at the lowermost circumference of the chair. It is to be understood that in such a chair the resilient elements could also be located somewhat inside the outer circumference of the bottom portion of the chair, and it is also to be understood that in chairs having such a round lower portion, the number of resilient elements as well as the location thereof could be varied within wide limits.

Figure 14:
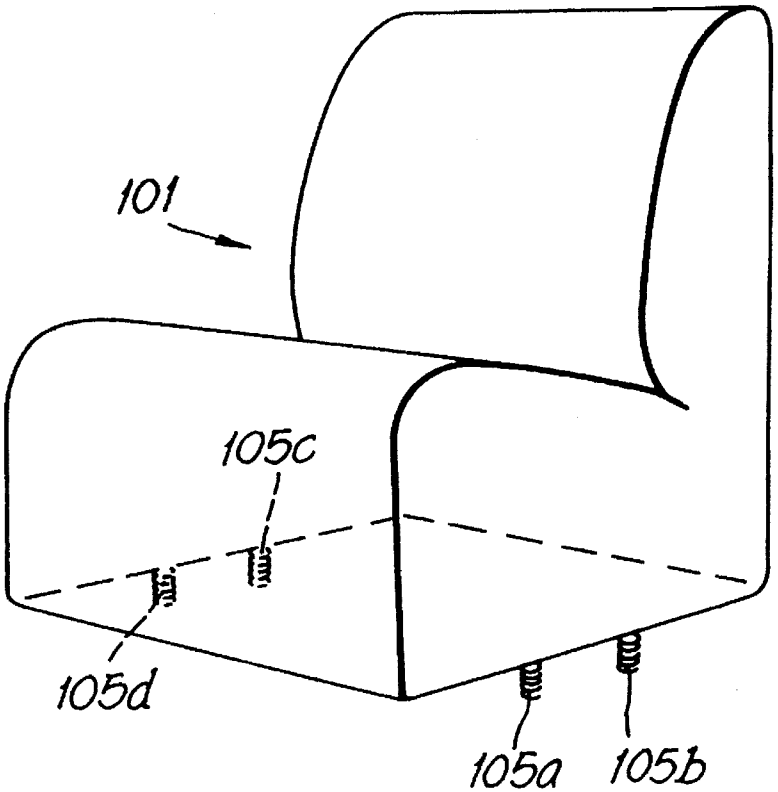
FIGS. 13, 14 and 15 illustrate various chair designs without legs, but provided with various embodiments of the arrangement according to the invention.

FIG. 14 illustrates a chair 101 in perspective view, being of closed type and comprising a plurality of resilient elements 105 attached to the bottom portion of the chair and resting directly on the floor. It is to be understood that the location of such elastic or resilient elements 105 could be located closer to the centre portion of the bottom surface of such chairs.

Figure 15:
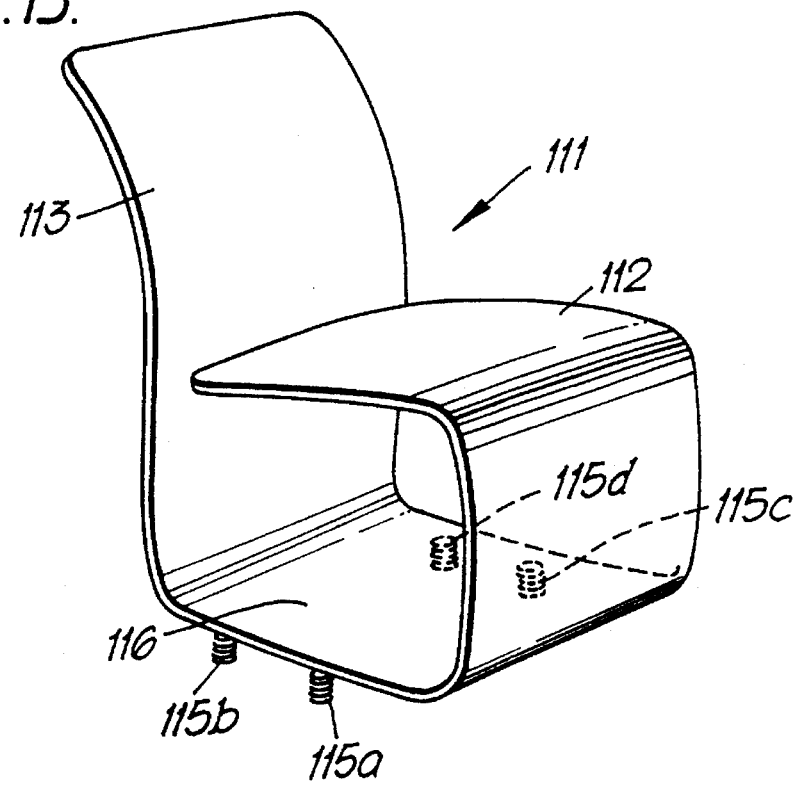

FIG. 15 illustrates a special embodiment of a chair 111 taking the form of a bent plate having a seat portion 112 and a back portion 113, as well as a lower portion 116 to which are attached a plurality of elastic or resilient elements 115.

It is to be understood that the number of resilient elements can be varied within wide limits, it being understood that only one resilient element at the bottom of the chair, or two, three or several resilient appropriately located and tuned elements could be contemplated, said elements being adapted to each other and in conformity with the expected resilient properties of the chair in question.

Figure 16:
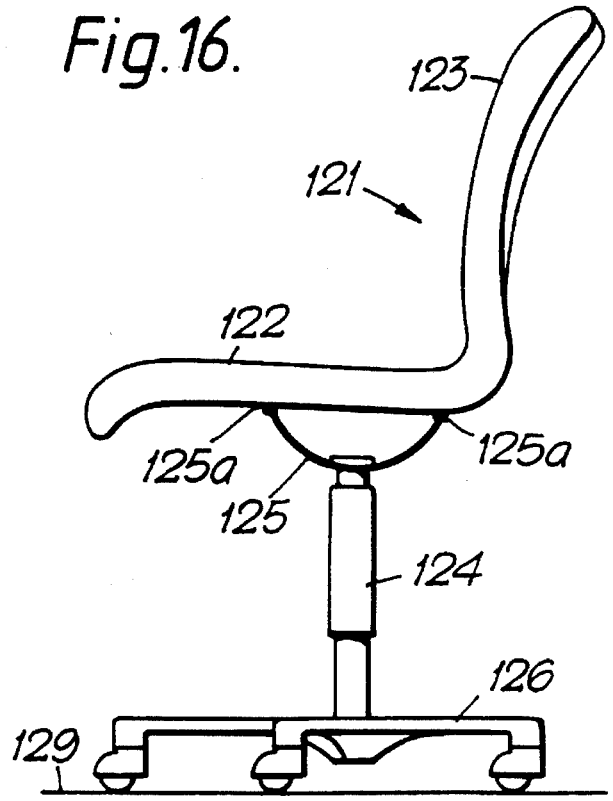
FIG. 16 is a side view of especially an office chair, in which a special embodiment of the arrangement according to the inventions included.

FIG. 16 illustrates in a side view an example of a typical office chair, in which the chair 121 comprises a seat member 122 and back member 123, and wherein one or several resilient elements 125 is or are provided immediately below the seat member 122. In the embodiment illustrated in FIG. 16, the resilient element or elements take the form of downwardly from the bottom surface of the chair member 122 curved leaf springs 125, the end portions 125*a* thereof being attached to the bottom surface of the seat member 122, whereas the central portions thereof are provided on an adjustable supporting column 124 resting on the base 126 of the chair 121. The base 126 of the chair is appropriately provided with castors 127, for thereby allowing rolling of the chair 121 along the floor 129.

In the embodiment illustrated in FIG. 17, there is illustrated an office chair 131 having a seat member 132 and a back member 133, as well as three resilient members 135*a*–135*c* provided immediately below the chair seat member 132, said resilient elements 135*a*–135*c* resting on a three-armed supporting member 138 which in turn is provided on the top of an adjustable supporting collumn 134, which in turn is carried by a base 136 provided with castors 137.

Figure 17:
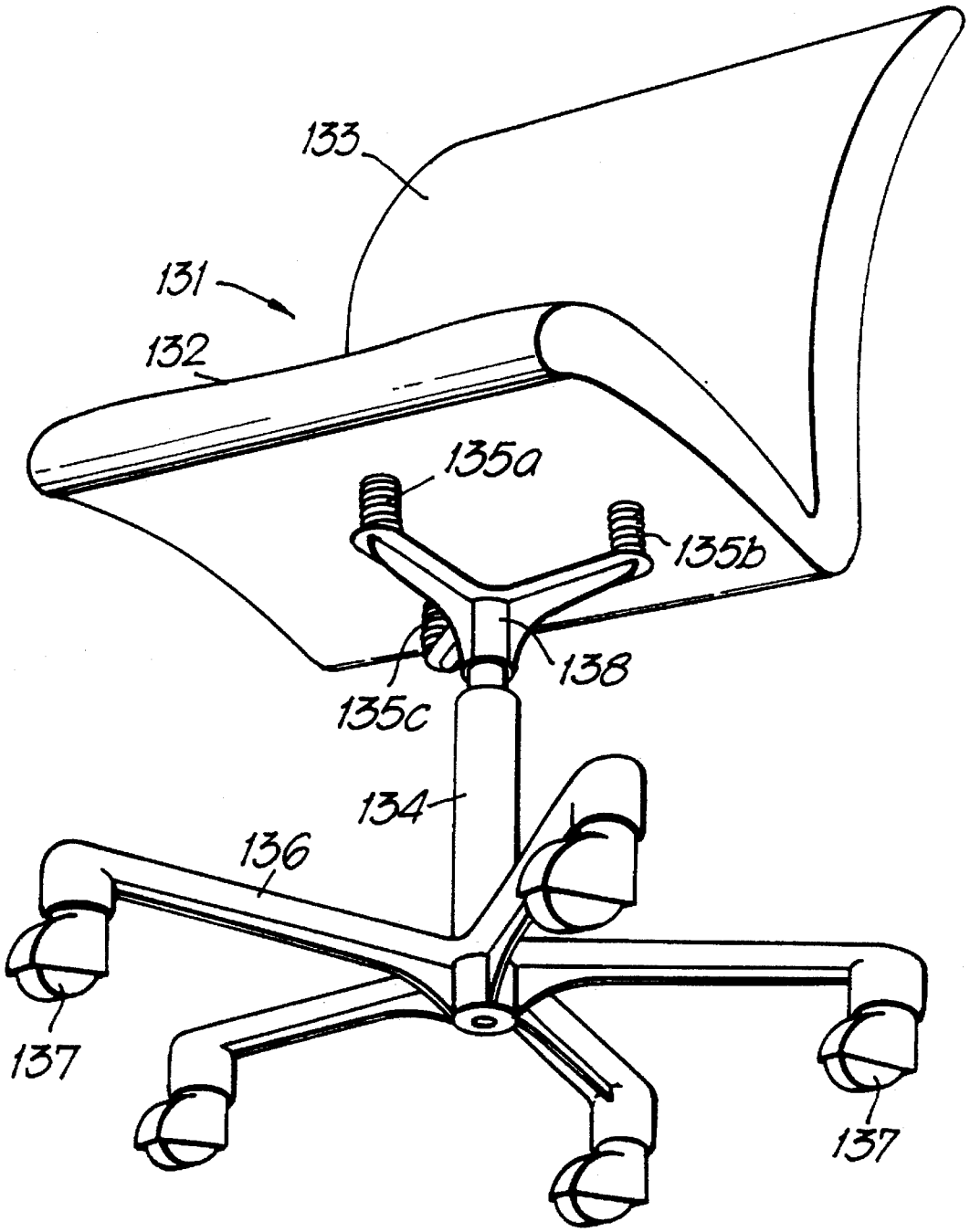
FIG. 17 is a perspective view of especially an office chair, in which yet another embodiment of the arrangement according to the invention is included.
Figure 18:
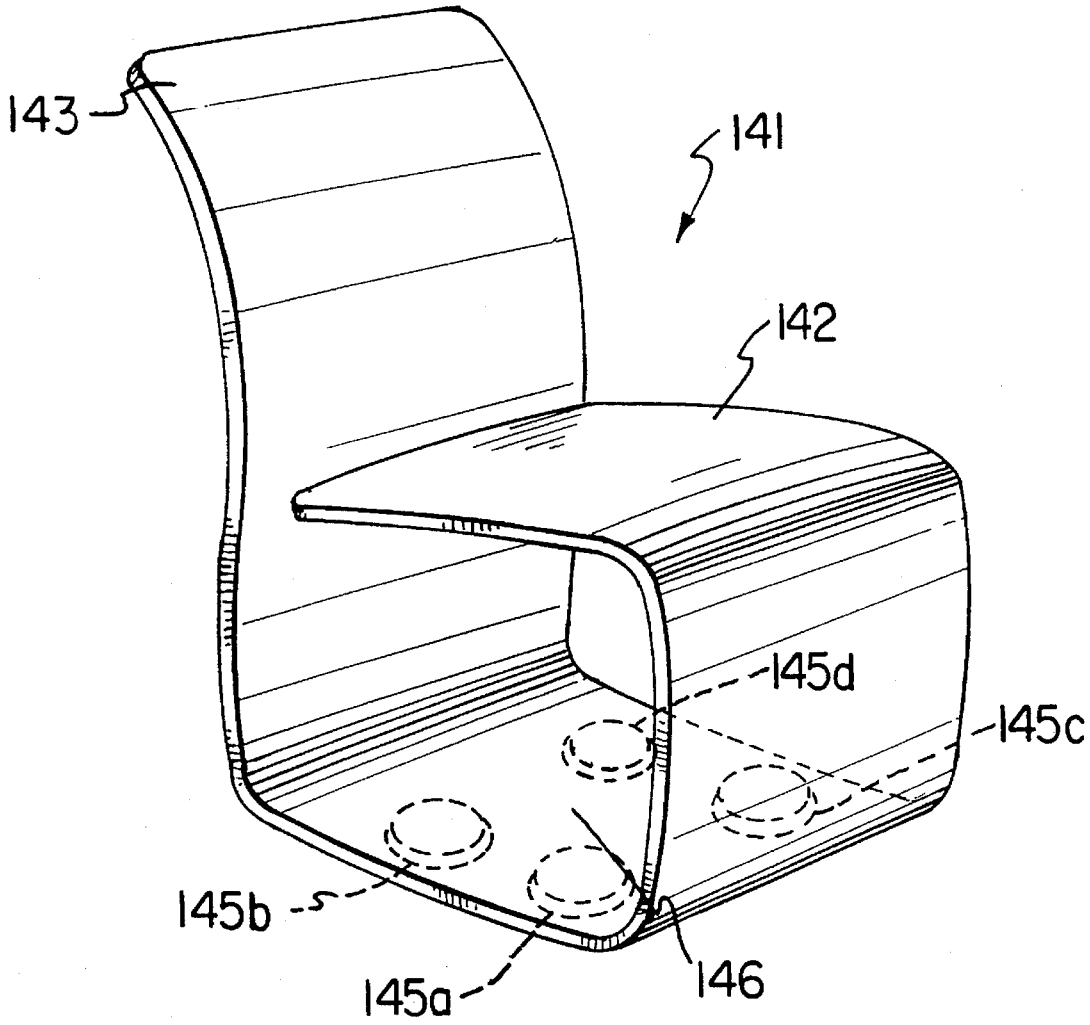
FIG. 18 is a perspective view of another embodiment of the invention.

It is to be understood that the office chairs according to FIGS. 16 and 17 could be modified within wide limits, the number of resilient elements and the type of material from which these are manufactured, being subjected to selections, adaptions and modifications, all in dependence of the expected universal freedom of movement to be built into these chairs. FIG. 18 shows a view of a chair 141 similar to that of FIG. 15 in which air pillows 145 are mounted to the chair bottom to serve as the resilient elements.

I claim:

1. A chair for resting on a floor comprising:

a seat for a user, means for supporting said seat relative to the floor, said supporting means comprising at least one resilient element located between the seat and the floor to provide movement of the chair and the seat thereof in up and down, vertical, forward and rearward and sidewards directions and combinations thereof, at least one supporting rod attached to said supporting means below said seat and extending along a respective side of said seat and beyond the front and rear of the seat, each end of each said at least one rod establishing a stop for the forward and rearward tilting of the chair on said at least one resilient element.

2. A chair for resting on a floor comprising:

a seat for a user, means for supporting said seat relative to the floor, said supporting means comprising at least one resilient element located between the seat and the floor to provide movement of the chair and the seat thereof in up and down, vertical, forward and rearward and sidewards directions and combinations thereof, said supporting means comprises a plurality of downwardly extending legs connected to said seat, one said resilient element being provided at the bottom end of each said leg to contact the floor, a supporting rod attached to a leg on each side of said seat and extending beyond the front and rear of the seat, each end of a said rod establishing a stop for the forward and rearward tilting of the chair on said resilient elements.

3. A chair for resting on a floor comprising:

a seat for a user, means for supporting said seat relative to the floor, said supporting means comprising at least one resilient element located between the seat and the floor to provide movement of the chair and the seat thereof in up and down, vertical, forward and rearward and sidewards directions and combinations thereof, said supporting means further comprises at the lower end thereof a pair of spaced runners, each said runner extending forwardly and rearwardly of said seat, and a pair of said resilient elements mounted to the lower part of each said runner to rest on the floor, each end of each said runner establishing a stop for the forward and rearward tilting of the chair on said resilient elements.

4. A chair as in claim 3 wherein said pair of resilient elements is mounted on each runner below the seat.

5. A chair as in claim 4 wherein said runners are straight.

6. A chair as in claim 4 wherein said runners are curved.

* * * * *